US008345034B2

(12) United States Patent
Fukuda et al.

(10) Patent No.: US 8,345,034 B2
(45) Date of Patent: Jan. 1, 2013

(54) ADDRESS DRIVE CIRCUIT AND PLASMA DISPLAY APPARATUS

(75) Inventors: Tomoyuki Fukuda, Hamura (JP); Nobuaki Kabuto, Kunitachi (JP); Junichi Yokoyama, Fujisawa (JP); Hisafumi Imura, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 1018 days.

(21) Appl. No.: 12/333,724

(22) Filed: Dec. 12, 2008

(65) Prior Publication Data

US 2009/0153065 A1 Jun. 18, 2009

(30) Foreign Application Priority Data

Dec. 14, 2007 (JP) ..... 2007-322714

(51) Int. Cl.
*G09G 3/28* (2006.01)
*G09G 5/00* (2006.01)
*H05B 39/04* (2006.01)

(52) U.S. Cl. ..... 345/212; 345/60; 345/204; 345/211; 315/209 R; 315/217; 315/224

(58) Field of Classification Search ..... 345/60, 345/204, 211, 212; 315/169.4, 209 R, 224, 315/291
See application file for complete search history.

(56) References Cited

U.S. PATENT DOCUMENTS

| | | | | |
|---|---|---|---|---|
| 4,866,349 | A | 9/1989 | Weber et al. | |
| 6,376,995 | B1 | 4/2002 | Kato et al. | |
| 6,400,344 | B1 * | 6/2002 | Tsunoda et al. | 345/60 |
| 6,452,590 | B1 | 9/2002 | Awamoto et al. | |
| 6,753,831 | B1 * | 6/2004 | Ide et al. | 345/60 |
| 7,397,497 | B2 * | 7/2008 | Murakami et al. | 348/173 |
| 7,436,374 | B2 * | 10/2008 | Chi | 345/60 |
| 7,701,415 | B2 * | 4/2010 | Gotoda et al. | 345/60 |
| 7,737,918 | B2 * | 6/2010 | Jeong | 345/63 |
| 2004/0201552 | A1 | 10/2004 | Onozawa et al. | |
| 2004/0212561 | A1 * | 10/2004 | Matsuda et al. | 345/60 |
| 2006/0044223 | A1 * | 3/2006 | Yang et al. | 345/60 |
| 2007/0085775 | A1 * | 4/2007 | Choi | 345/68 |

FOREIGN PATENT DOCUMENTS

| | | |
|---|---|---|
| JP | 7-109542 | 11/1995 |
| JP | 2000-206929 A | 7/2000 |
| JP | 2000-242223 | 9/2000 |
| JP | 2003-533722 | 11/2003 |
| JP | 2004-309983 | 11/2004 |
| KR | 10-0555774 | 5/2006 |
| WO | WO 01/88893 A1 | 11/2001 |

OTHER PUBLICATIONS

Japanese Office Action issued in Japanese Patent Application No. 2007-322714 dated Aug. 21, 2012.

* cited by examiner

*Primary Examiner* — William Boddie
*Assistant Examiner* — Alecia D English
(74) *Attorney, Agent, or Firm* — McDermott Will & Emery LLP

(57) ABSTRACT

A circuit configuration for realizing high impedance in an address drive circuit is provided in order to reduce the number of recovery switches without reducing power recovery efficiency. A mechanism for realizing the high impedance in an address drive circuit during a sustain period of a plasma display panel is provided. By achieving the high impedance, capacitance coupling between an X electrode and an address electrode and between a Y electrode and an address electrode can be cancelled, and a power recovery circuit can be simplified without reducing the power recovery efficiency.

5 Claims, 8 Drawing Sheets

ADDRESS DRIVE CIRCUIT AND PLASMA DISPLAY APPARATUS

CROSS-REFERENCE TO RELATED APPLICATION

The present application claims priority from Japanese Patent Application No. JP 2007-322714 filed on Dec. 14, 2007, the content of which is hereby incorporated by reference into this application.

TECHNICAL FIELD OF THE INVENTION

The present invention relates to a drive circuit of a plasma display panel and a plasma display apparatus using the same.

BACKGROUND OF THE INVENTION

A plasma display panel of a self-luminous type has excellent visibility and is flat and suitable for large-screen display and high-speed display. For this reason, the plasma display panel has been rapidly spreading as a display panel to replace the CRT in recent years. On the other hand, increase of power consumption resulting from the rapid screen size increase poses a problem for a plasma display, and a resonance circuit called a power recovery circuit which regards a panel as a large capacitor is utilized. By this means, most of the input power is recovered and the reduction of power consumption can be achieved.

The invention described in Japanese Patent Application Laid-Open Publication No. 2004-309983 (Patent Document 1) discloses a power recovery circuit comprising a resonance coil, a diode, a MOS transistor functioning as a switch, a capacitor for recovery, and the like in a path for charging and discharging a panel capacitor. According to the disclosure of Japanese Examined Patent Application Publication No. 07-109542 (Patent Document 2) in which the operation of the power recovery circuit is described in detail, by the resonance operation formed by a coil and a panel capacitor Cp of a plasma display panel, charges accumulated in the panel capacitor Cp are recovered in a recovery capacitor. Thereafter, charges recovered in the recovery capacitor are supplied to the panel capacitor Cp. Hereinafter, this action is referred to as "power recovery" for convenience sake.

As described above, the power recovery circuit is included in respective sustain drive circuits for X electrodes and Y electrodes. On the other hand, the power recovery circuit is one of the factors for complicating the sustain drive circuit. For the simplification of the recovery circuit, the reduction of the number of switches (hereinafter, recovery switch) provided in series in a path from the panel electrode to the recovery capacity has been proposed.

Since this method is disclosed in published Japanese translation of a PCT application No. 2003-533722 (Patent Document 3), detailed description thereof is omitted here. However, in order to realize the power recovery in spite of the reduction of the number of recovery switches, it is essential to achieve reliable propagation of drive voltage change applied to one electrode to the other electrode.

SUMMARY OF THE INVENTION

However, address electrodes are provided in addition to the X electrodes and the Y electrodes in an actual plasma display panel. Since the address electrode interferes with voltage change between the X electrode and the Y electrode, it is difficult to realize the power recovery operation as described above. Specifically, voltage change Vs2−Vs1 (difference between sustain voltages) applied to the X electrode or the Y electrode is divided by the capacitance coupling with the address electrode, and the voltage change of the Y electrode or the X electrode does not reach the voltage change Vs2−Vs1 required for the power recovery.

The sustain voltage Vs2 and the sustain voltage Vs1 mentioned here are the potentials of the X electrode and the Y electrode in a sustain period.

As described above, even if the number of recovery switches is simply reduced in order to simplify the sustain drive circuit configuration, the power recovery circuit does not function. In order to avoid the power recovery efficiency reduction, the capacitance coupling with the address electrode has to be canceled.

For the solution of the problem, a focus is placed on the fact that the address drive circuit is required to operate only in an address period. By providing a switch for blocking an input signal to the address drive circuit and a power supply of the address drive circuit, the address drive circuit is set to an ordinary connection during the address period and is put into a high impedance state during the sustain period in which the power recovery is carried out. By this means, the capacitance coupling is cancelled.

As a circuit for realizing this configuration, a switch element such as a photo coupler or an electromagnetic coupler has been used conventionally. However, since introduction of these elements negates an original object, that is, the cost reduction effect by the reduction of the recovery switch elements, it is hard to say that this is a solution suitable for the object.

An object of the present invention is to provide a method of realizing a circuit configuration capable of achieving high impedance in an address drive circuit so as to reduce the recovery switches without losing the power recovery efficiency.

The above and other objects and novel characteristics of the present invention will be apparent from the description of this specification and the accompanying drawings.

The typical ones of the inventions disclosed in this application will be briefly described as follows.

A plasma display apparatus according to a representative embodiment of the present invention comprises: sustain drive circuits each including a power recovery circuit on a scan electrode side and a sustain electrode side of a plasma display panel; and an address drive circuit for driving address electrodes, wherein the address drive circuit has a plurality of output side switch elements which can switch and output an address voltage and a non-address voltage on an address electrode side, and an address voltage control switch is provided on a power supply side of the plurality of output side switch elements.

A power supply voltage control switch is provided on a power supply side of a plurality of input side elements of the address drive circuit.

In this address drive circuit, a signal from an image signal processing circuit is input to a data input terminal of the address drive circuit, and an input signal switch for blocking an input signal is inserted between the image signal processing circuit and the address drive circuit.

These address drive circuits further comprise: a grounding control switch which performs switching whether or not the non-address voltage is grounded.

These address drive circuits further comprise: a logic input fixing switch which connects the non-address voltage and the data input terminal.

This address drive circuit further comprises: a latch circuit which fixes an input to the address drive circuit.

In this address drive circuit, the latch circuit is formed from an RS flip flop.

In this address drive circuit, the input signal switch, the address voltage control switch, the power supply voltage control switch, and the grounding control switch are turned OFF during a sustain period, and the address drive circuit is put in a floating state.

In this address drive circuit, a logic input fixing switch is turned ON during the sustain period to fix the data input terminal of the address drive circuit.

In these address drive circuits, a MOS transistor or a diode is applied to the address voltage control switch and the power supply voltage control switch.

A plasma display apparatus characterized by using these address drive circuits is also included in the scope of the present invention.

The effects obtained by typical one of the inventions disclosed in this application will be briefly described below.

According to the plasma display drive circuit of the representative embodiments of the present invention, an address drive circuit can be temporarily put in a high impedance state by providing a switch, which can block a data signal, between the address drive circuit and an image signal processing circuit. By this means, an effect which is difficult to be achieved in the conventional art can be realized. In other words, the number of switch elements can be reduced without losing the power recovery efficiency in the power recovery circuits mounted in the sustain drive circuits for the scan electrodes and the sustain electrodes, and the power recovery circuit can be simplified.

BRIEF DESCRIPTIONS OF THE DRAWINGS

DESCRIPTIONS OF THE PREFERRED EMBODIMENTS

In the present invention, address electrodes are temporarily put in a floating state by putting an address drive circuit in a high impedance state during a sustain period. As a result, a capacitance coupling between an X electrode and an address electrode and between a Y electrode and an address electrode in a plasma display panel can be canceled. Hereinafter, embodiments of the present invention will be described with reference to the drawings.

First Embodiment

Figure 1:
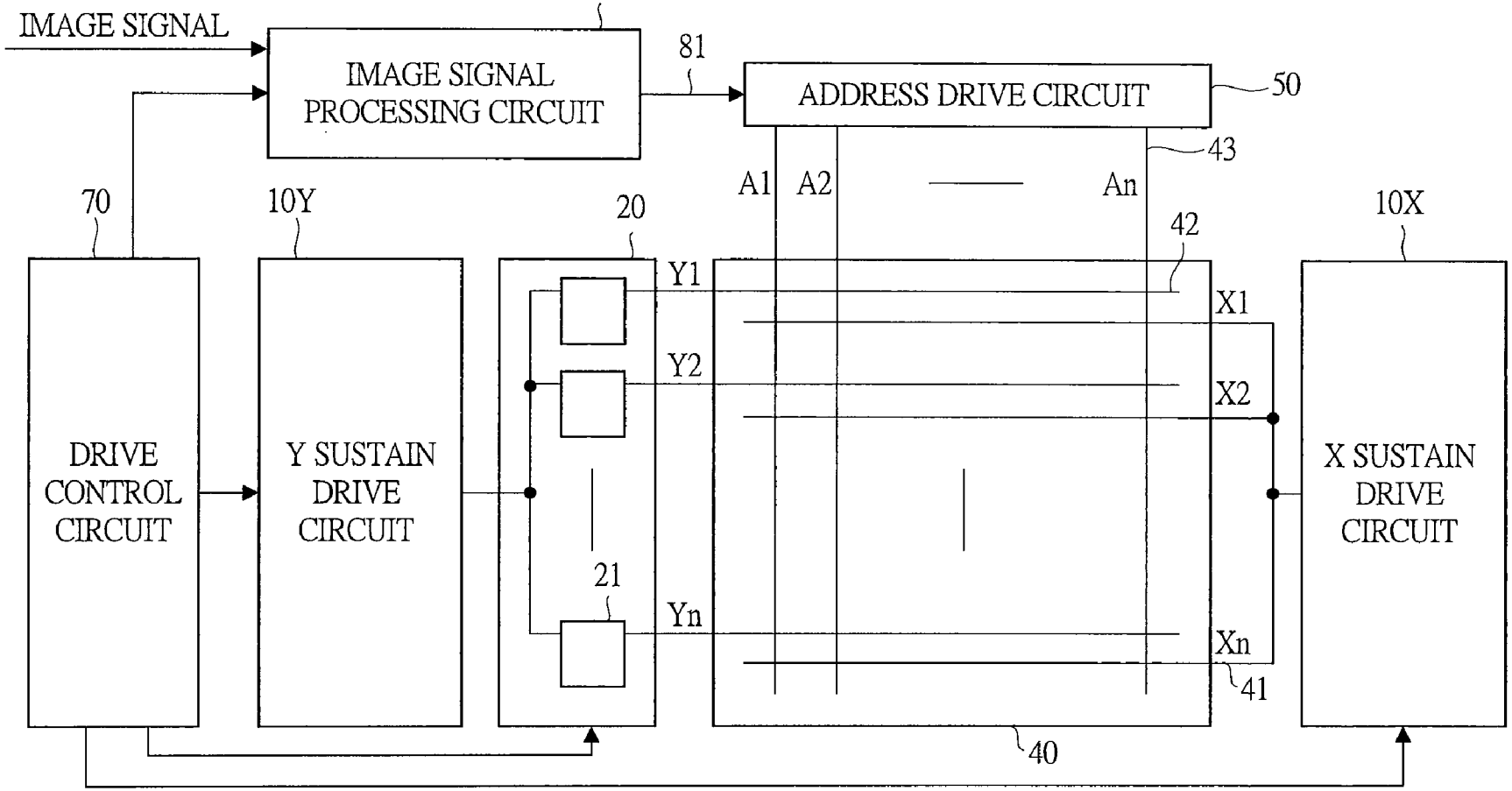
FIG. 1 is a schematic entire configuration diagram of a circuit of a plasma display apparatus.
Figure 2:
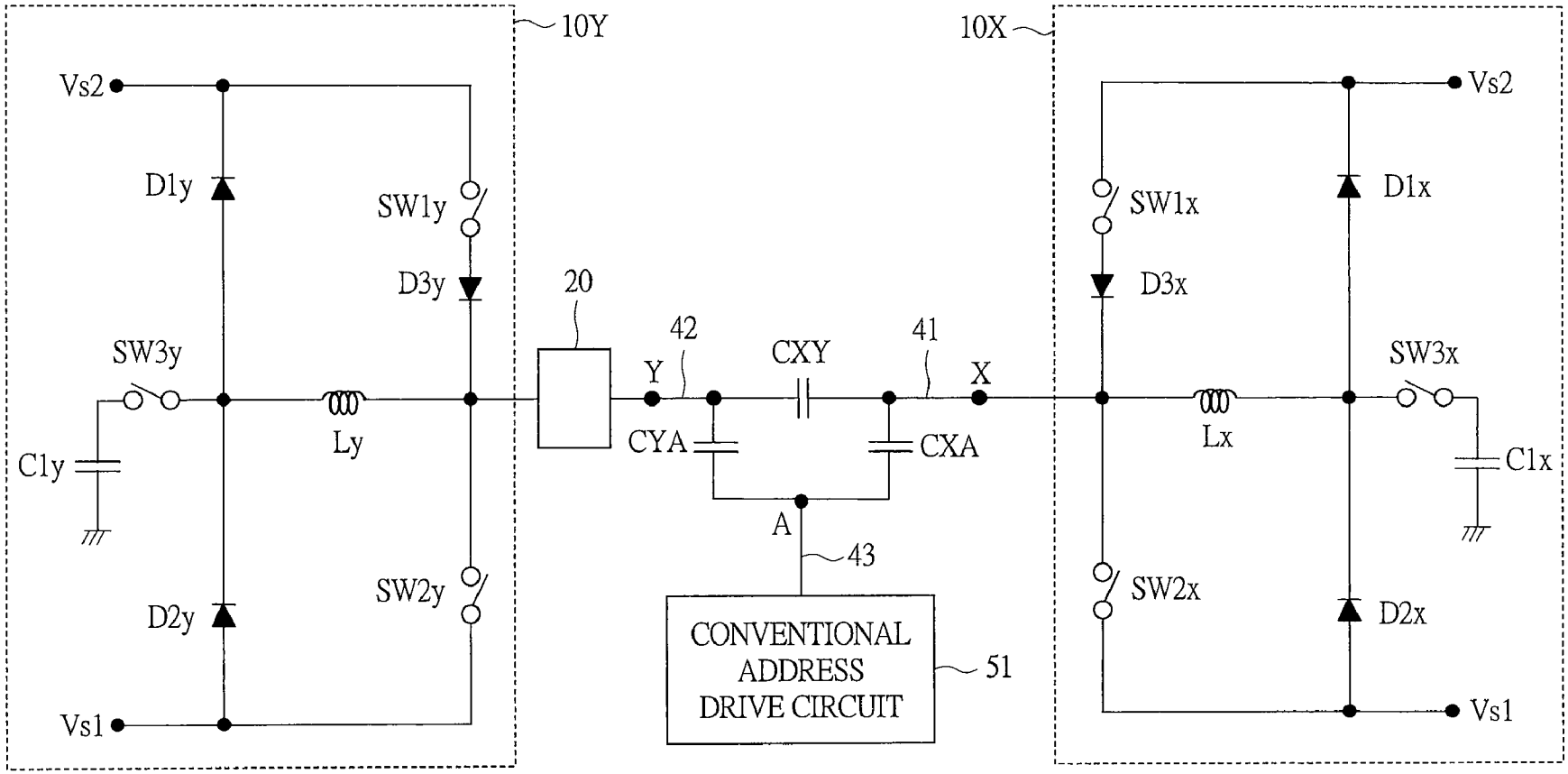
FIG. 2 is a configuration diagram showing a conventional configuration of a plasma display drive circuit.
Figure 3:
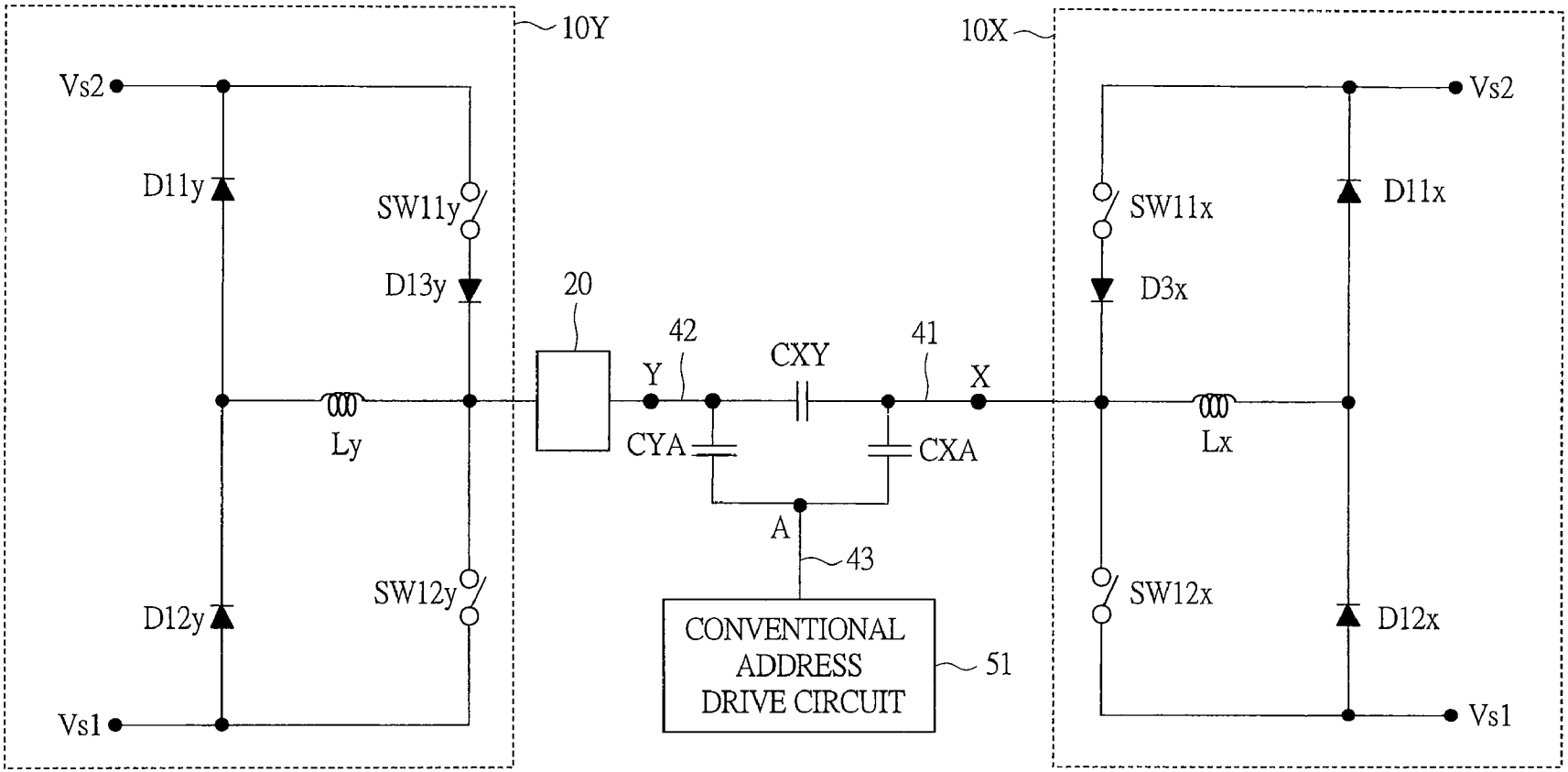
FIG. 3 is a configuration diagram showing another conventional configuration of a plasma display drive circuit.
Figure 4:
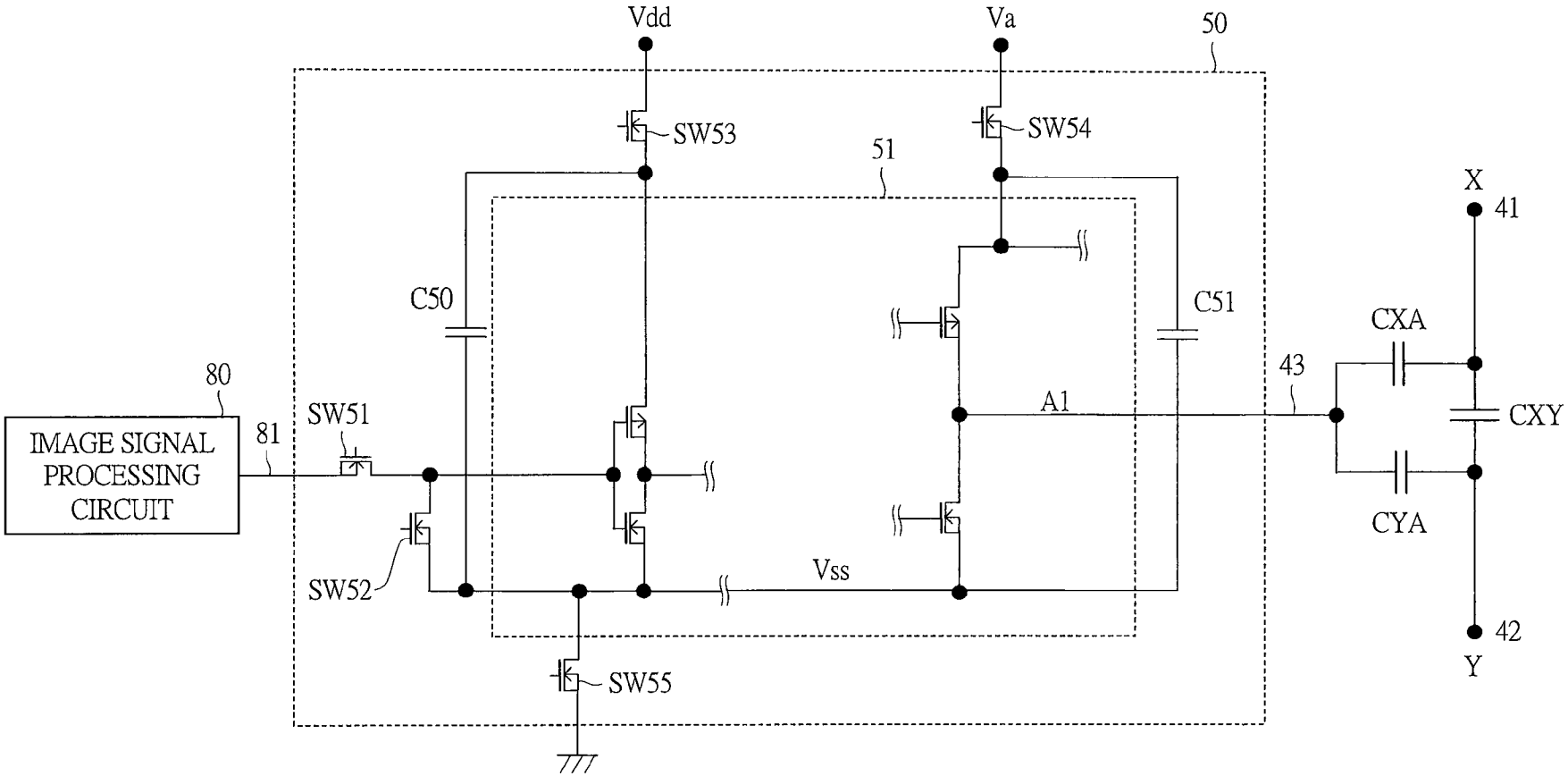
FIG. 4 is a circuit diagram showing an address drive circuit according to a first embodiment.
Figure 5:
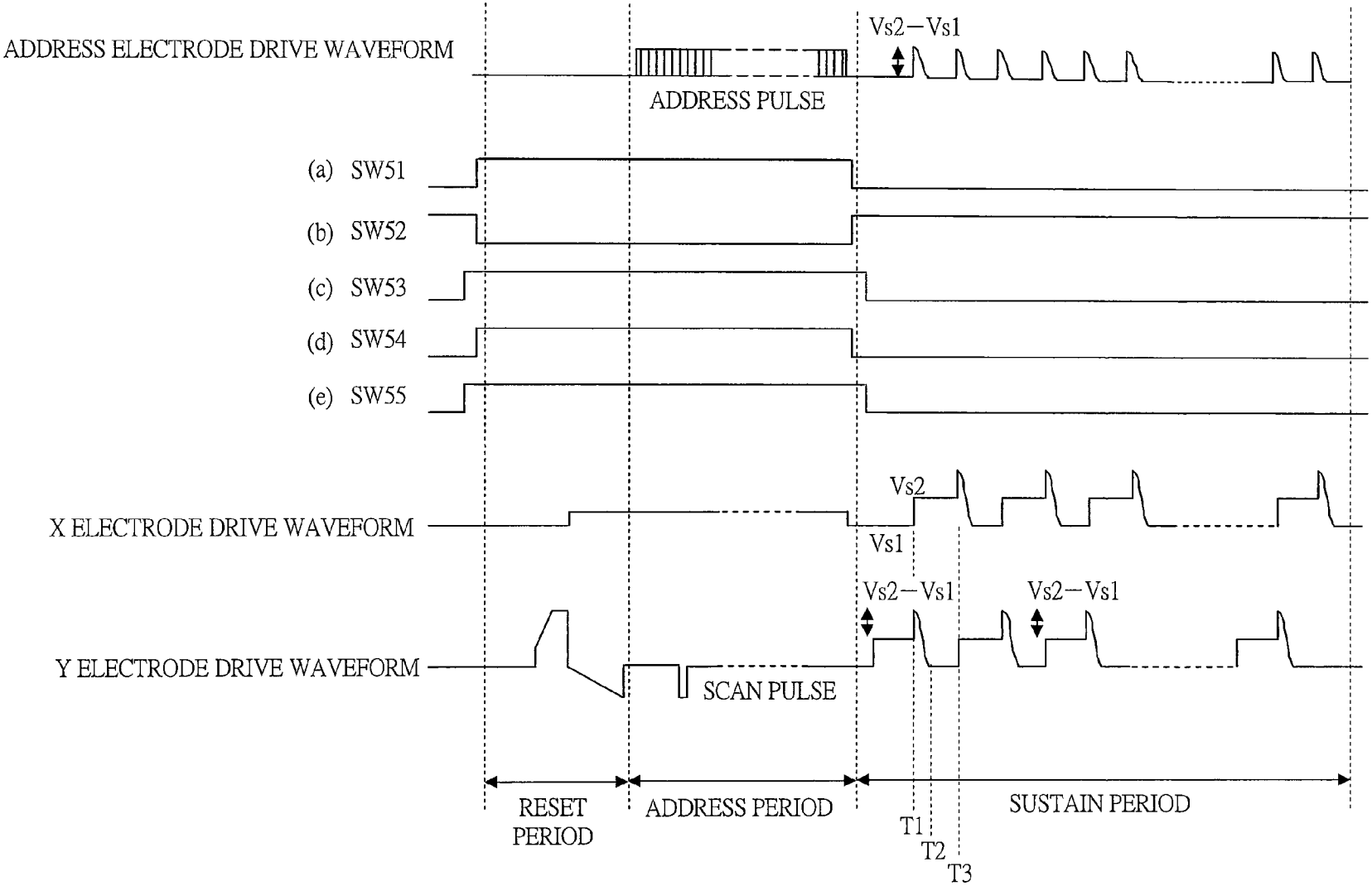
FIG. 5 is a timing chart showing an operation of the address drive circuit according to the first embodiment.

FIG. 1 is a schematic entire configuration diagram of a plasma display apparatus, and FIGS. 2 and 3 are diagrams showing conventional configurations of a plasma display drive circuit. Also, FIG. 4 is a circuit diagram showing an address drive circuit 50 according to a first embodiment, and FIG. 5 is a timing chart showing an operation of the address drive circuit 50 according to the first embodiment. First, a schematic entire configuration of a circuit of a plasma display apparatus will be described with reference to FIGS. 1 to 3.

A general plasma display apparatus comprises an X sustain drive circuit 10X, a Y sustain drive circuit 10Y, a scan driver 20, a plasma display panel (PDP) 40, an address drive circuit 50, a drive control circuit 70, and an image signal processing circuit 80.

Each sustain drive circuit is a circuit for supplying a sustain pulse voltage for causing sustain discharge between display electrodes based on a control signal applied from the drive control circuit 70. The X sustain drive circuit 10X supplies the drive pulse voltage for driving X electrodes and the Y sustain drive circuit 10Y supplies the drive pulse voltage for driving Y electrodes, respectively.

The scan driver 20 is a drive circuit for operating scan electrodes. Switches 21 are provided in the scan driver 20, and switching is performed so as to sequentially apply scan pulses (not shown) during the address period in accordance with control signals from the drive control circuit 70 described later. Further, the Y electrodes are connected to the scan driver 20.

The scan driver 20 operates the switches 21 so that the Y electrodes are connected to the Y sustain drive circuit 10Y during the sustain discharge period.

Also, the X electrodes are connected to the X sustain drive circuit 10X to apply a predetermined drive voltage to a panel.

In the plasma display panel 40, n lines of X electrodes 41 and n lines of Y electrodes 42 are alternately arranged adjacent to each other. The X electrode and the Y electrode are called display electrodes and they may also be called sustain electrodes.

The address electrodes 43 are electrodes designating pixels to emit light and are output to the plasma display panel 40 by the address drive circuit. The address electrodes 43 are provided in a direction orthogonal to the display electrodes, and display cells (not shown) are formed at the intersecting portions of the respective display lines formed of the X electrodes and the Y electrodes and the respective address electrodes 43.

The address drive circuit 50 outputs pixel data for display to the address electrodes 43 in accordance with image data converted in the image signal processing circuit 80 and scan pulses from the scan driver 20 during the address period described later. The address drive circuit 50 includes the conventional address drive circuit 51 corresponding to the number of address signal lines of the plasma display panel 40.

The address drive circuit 50 is proposed by the present invention and it includes the conventional address drive circuit 51.

The drive control circuit 70 generates signals for controlling respective sections of the plasma display apparatus and supplies the signals to the X sustain drive circuit 10X, the Y sustain drive circuit 10Y and the image signal processing circuit 80.

The image signal processing circuit 80 converts an input digital image signal into a format suitable for the operation in the plasma display apparatus, and then supplies the signal to the address drive circuit 50.

The drive circuits in the plasma display apparatus are configured as described above, and respective constituent elements thereof are driven in the following manner, thereby controlling the plasma discharge.

Next, a driving method of the plasma display panel 40 will be described with reference to FIG. 2.

A driving procedure of the plasma display panel is roughly classified to a reset period, an address period and a sustain period.

In the reset period, wall charges in the discharge spaces are neutralized regardless of a lighting state in the sustain period before the reset period, and charge states in the respective discharge spaces are made uniform.

In the address period, corresponding pixel data is output from the address drive circuit 50 in accordance with scan pulses from the scan driver 20, and write pulses of an address voltage Va are supplied to only the cells to be lit from the address drive circuit 50. By this means, wall charges in such a degree that self-discharge does not occur are induced in the X electrodes and the Y electrodes (address discharge).

In the sustain period, a switch SW2*x* is made conductive to apply a low sustain voltage Vs1 to the X electrodes. Also, a switch SW1*y* is made conductive to apply a high sustain voltage Vs2 to the Y electrodes, so that the plasma display panel 40 performs sustain discharge.

In the next cycle, the switches SW1*y* and SW2*y* are turned OFF, and switches SW3*y* and SW3*x* are made conductive to generate a resonance operation of the panel capacitor and the coil. Thereafter, the Y electrodes are set to a sustain voltage Vs1 and a voltage Vs2 is applied to the X electrodes, so that discharge between the X electrodes and the Y electrodes is maintained. Note that the voltages in the description satisfy the relation of Vs1<Vs2.

FIG. 2 and FIG. 3 are different in whether or not the switches SW3*x* and SW3*y* and power recovery capacitors C1*x* and C1*y* are included in the respective sustain drive circuits. However, the switches SW3*x* and SW3*y* are large in current capacity and heat generation because they perform ON and OFF of the sustain discharge current. Therefore, it is inevitable to connect some elements in parallel, and measures for heat dissipation such as the provision of a heat sink are also required. As a result, the total cost prices of the products to be formed significantly differ. Note that FIG. 3 shows a circuit configuration described in Patent Document 3. In the embodiments of the present invention, the circuit configuration of the plasma display drive circuit shown in FIG. 3 is used.

Next, a circuit configuration of the address drive circuit 50 for realizing the high impedance in the address drive circuit according to the present embodiment will be described with reference to FIG. 4 and FIG. 5. In the address drive circuit 50, for realizing the high impedance, a plurality of switches are added to the conventional address drive circuit 51.

As described above, the recovery switches SW3*x* and SW3*y* and the like are removed from the power recovery circuit applied in the present embodiment. In order to achieve the function of the power recovery circuit with this circuit configuration, it is necessary to eliminate a panel capacitor CXA between the X electrode and the address electrode and a panel capacitor CYA between the Y electrode and the address electrode caused from the capacitance couplings between the address electrode 43 and the X electrode and between the address electrode 43 and the Y electrode by realizing the high impedance in the address drive circuit.

Therefore, in order to realize the high impedance in the conventional address drive circuit 51, switches for blocking signals input to the address circuit, namely, a switch SW51 (input signal switch) provided on a data input terminal 81 from the image signal processing circuit 80, a switch SW52 (logic input fixing switch) connecting the data input terminal 81 to a ground level of the conventional address drive circuit 51, and switches SW53 (power supply voltage control switch) and SW54 (address voltage control switch) blocking power supplied to the conventional address drive circuit 51 are provided. Further, a switch SW55 (ground control switch) for determining whether a non-address voltage Vss is grounded or put in a floating state is also provided.

The switch SW51 is a switch for blocking an input signal from the image signal processing circuit 80 to the conventional address drive circuit 51.

The switch SW52 is a switch for connecting the potential of the input terminal of the conventional address drive circuit 51 to a ground level. By the connection to the ground level, the logic input is fixed to prevent malfunction of the conventional address drive circuit 51.

The switch SW53 is a switch for determining whether or not a power supply voltage Vdd is supplied to an input switch group of the conventional address drive circuit 51. Also, the switch SW54 is a switch for determining whether or not an address voltage Va is supplied to an output switch group of the conventional address drive circuit 51.

The switch SW55 is a switch for determining whether a non-address voltage Vss is grounded or put in a floating state. The non-address voltage Vss mentioned here represents a potential different from the power supply voltage Vdd and the address voltage Va. When the switch SW55 is in an ON state, the voltage Vss becomes a ground level, and when the switch SW55 is in an OFF state, the voltage Vss becomes a floating state.

Note that the switches SW51, SW52, SW53, SW54 and SW55 are characterized by being formed of MOS transistors. By using the MOS transistors, a channel unit price can be reduced, and thus the influence on the cost price of a whole product can be decreased.

Two power supply voltages of the power supply voltage Vdd and the address voltage Va are input to the conventional address drive circuit 51 in FIG. 4. The power supply voltage Vdd is a power supply voltage of a logic circuit in the conventional address drive circuit 51 which processes a signal from the image signal processing circuit 80 to control the address drive circuit. On the other hand, the address voltage Va shows a power supply to an output stage that drives the address electrode 43.

Also, the non-address voltage Vss is a reference voltage at the time of the switching to the ground or to the floating state. When the switch SW55 turns ON, the voltage Vss is grounded (Vss becomes the ground level). When the switch SW55 turns OFF, the non-address voltage Vss is put in the floating state.

In the period where the address drive circuit is put in a floating state by the capacitor C50 provided between the power supply voltage Vdd and the voltage Vss and the capacitor C51 provided between the address voltage Va and the voltage Vss, the respective power supply voltages are maintained.

Note that the data input terminal 81 from the image signal processing circuit 80 is ordinarily plural in number, but one input terminal and one output terminal are shown in FIG. 4 as representatives.

Subsequently, operation timings of respective switches will be described with reference to FIG. 5.

Since the address drive circuit 50 receives pixel data from the image signal processing circuit 80 and outputs pixel data from the address electrodes 43 in the address period, the switch SW51 and the switches SW53 and SW54 are made conductive.

Thereafter, the switch SW51 is turned OFF in the sustain period to break the connection with the image signal processing circuit 80. Also, the switch SW52 is made conductive so that the conventional address drive circuit 51 is connected to the ground level. At this time, since it is necessary to block the power supply to the address drive circuit, the switches SW53 and SW54 are turned OFF. This is because, when the sustain drive voltage exceeds the address drive voltage, if the switches SW53 and SW54 are conductive and address power is being supplied, the address electrode 43 can take a floating state only in a range of a power supply voltage of the address drive circuit. Regarding the input and blocking of the power supply voltage Vdd and the address voltage Va, inputting should be made in the order of the power supply voltage Vdd and the address voltage Va, and blocking should be made in the order of the address voltage Va and the power supply voltage Vdd.

A control example of the respective switches will be described below. The logic input signal switches SW51 and SW52 are controlled in the power supply voltage Vdd and GND levels and they require the withstand voltage of Vs2−Vs1 or higher as shown by (a) and (b) in FIG. 5. Also, the switch SW55 (control switch for controlling the non-address voltage Vss) is similar to the above ((e) in FIG. 5).

The address drive circuit power supply control switches SW53 and SW54 are similarly controlled in the power supply voltage Vdd and GND levels and they require the withstand voltages of Vs2−Vs1−Vdd or higher and Vs2−Vs1−Va or higher in view of their power supply voltages ((c) and (d) in FIG. 5).

By controlling the switches SW51 to SW55 in this manner, the address drive circuit including signals and power supplies during the sustain period is completely put in the high impedance state, and the capacitance coupling with the X and Y electrodes can be cancelled. As a result, as shown in the sustain period in FIG. 5, the potential change Vs2−Vs1 generated when the X electrode or the Y electrode applied with the low sustain voltage Vs1 transits to the high sustain voltage Vs2 is propagated to the Y electrode or the X electrode via the panel capacitor. Thereafter, as shown in FIG. 3, the Y electrode potential drops by the resonance operation of the recovery coil Ly or the recovery coil Lx and the panel to reach the sustain voltage Vs1, and then clamped by making the switch SW12*y* or the switch SW12*x* conductive. Subsequently, the potential change Vs2−Vs1 is propagated to the X electrode or the Y electrode at the rising of the Y electrode. Thereafter, the same is repeated. In this manner, the power recovery can be realized without reducing the power recovery efficiency even if the power recovery switches SW3*x* and SW3*y* are eliminated.

As described above, according to the present embodiment, high impedance of the address drive circuit can be achieved by a simple circuit configuration such as a plurality of switches for blocking signals and power supplies. Accordingly, the reduction of the power recovery efficiency which is a conventional problem caused when the recovery switches are reduced can be suppressed, and the cost merit from the reduction of the recovery switches can be obtained.

Further, as a result of the reduction of the recovery switches, a wiring length in the resonance circuit for performing power recovery can be shortened, and the power loss due to the wiring resistance can be reduced.

Second Embodiment

Next, a second embodiment of the present invention will be described.

In this embodiment, a plurality of switches are provided in order to realize high impedance in the address drive circuit, and a switch SW52 thereof is provided for the purpose of fixing a logic state in the address drive circuit during the high impedance period. A control example of the switch SW52 will be described with reference to FIG. 6.

Figure 6:
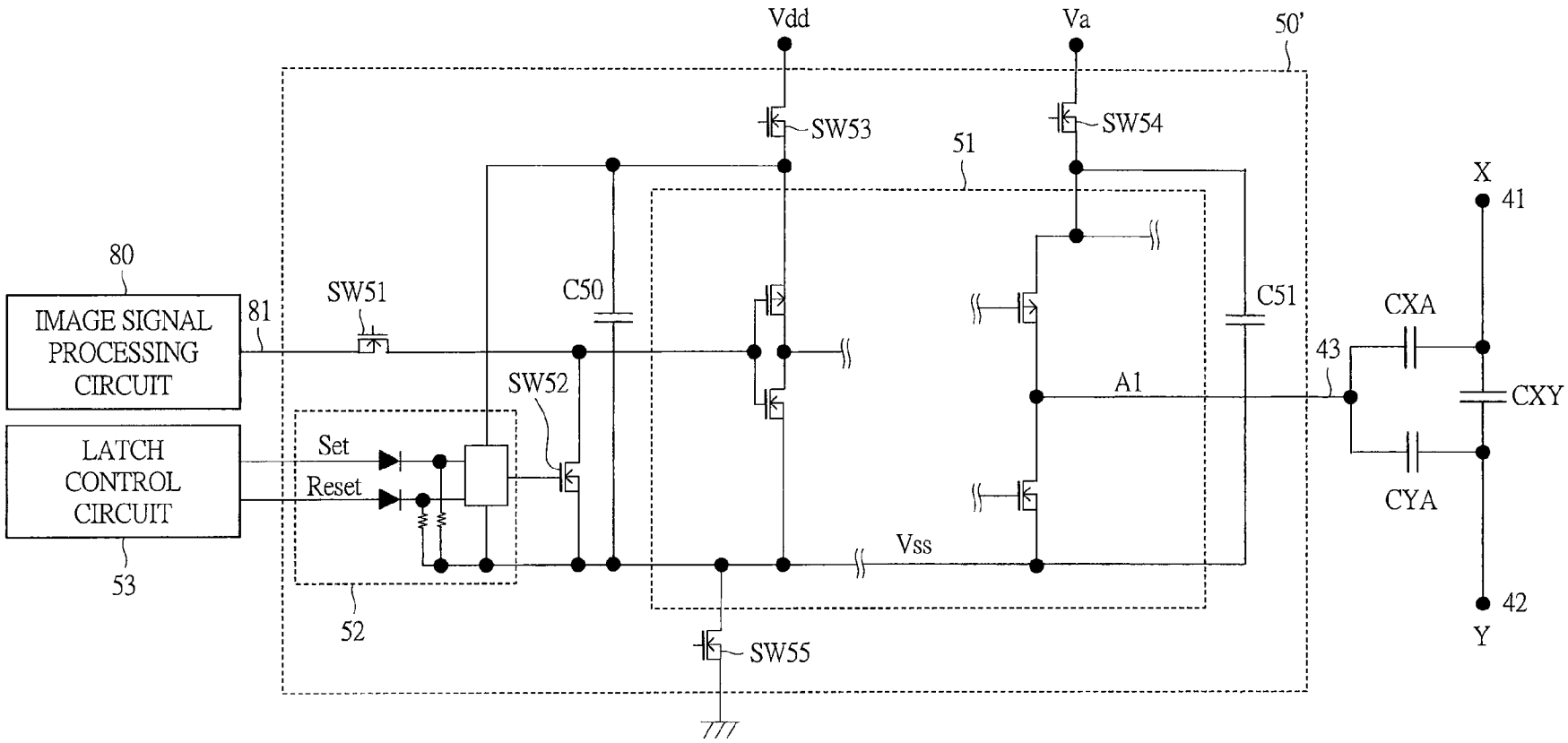
FIG. 6 is a circuit diagram showing an address drive circuit according to a second embodiment.

FIG. 6 is a circuit diagram showing an address drive circuit 50' according to the second embodiment of the present invention.

As compared with the first embodiment, a latch circuit 52 and a latch control circuit 53 are added in the address drive circuit 50' according to the second embodiment. An operation of the added elements will be mainly described below.

The voltage Vss in the high impedance period is a floating state. Therefore, it is necessary to control a gate terminal of the switch SW52 in accordance with the voltage Vss of the floating state in order to continue the conduction of the switch SW52. The latch circuit 52 is provided for achieving this object. Further, the latch circuit 53 is provided outside the conventional address drive circuit 51 for controlling the latch circuit 52.

An RS flip flop is applied to the latch circuit 52. The RS flip flop is provided with a Set terminal and a Reset terminal as input terminals for external control. A High level state (H level) or a Low level (L level) can be stored in the latch circuit 52 by the respective terminals. Then, the H level or the L level is output from an output terminal in accordance with the stored state.

Specifically, when the H level is input to the Set terminal, the latch circuit 52 stores the H level therein and outputs the H level from the output terminal. Thereafter, even if input of the Set terminal is changed to L level, since the H level is maintained in the latch circuit 52, the output terminal can continue to output the H level. When the H level is input from the Reset terminal, a holding state in the latch circuit 52 is reset and the output is changed to the L level.

Based on the operation of the RS flip flop, an operation of the latch circuit 52 will be described.

All outputs of the image signal processing circuit 80 are set to the L level during sustain period before the conventional address drive circuit 51 is put to a floating state, and a signal (H level) is applied to the latch circuit 52 from the Set terminal, so that the latch circuit 52 is put to a latch state and the switch SW52 is turned ON. After the latch circuit 52 is put to the latch state, the Set terminal is changed to the L level.

Subsequently, the switch SW51 is turned OFF and a signal from the image signal processing circuit 80 is blocked.

Thereafter, a sustain operation is started. Voltage change of Vs2−Vs1 occurs in the address drive circuit during the sustain period. Since an external control circuit of the latch circuit 52 is connected to the Set and Reset terminals via diodes, even if reverse bias voltage is applied during the sustain period, it is put in a blocked state and protected. Further, since the Reset and Set terminals are pulled down to Vss by resistance, the L level can be continued. By this means, conduction of the switch SW52 is maintained and malfunction of the address drive circuit can be prevented.

After the sustain period, the latch state is cancelled by applying a Reset signal and the switch SW52 is turned OFF. Then, the switch SW51 is made conductive, and the image signal processing circuit 80 and the address drive circuit are connected to each other.

By providing the latch circuit 52 in this manner, the latch circuit 52 ensures the conduction of the switch SW52 during the high impedance period. Therefore, the control in accordance with the voltage Vss of the floating becomes unnecessary, and the control of the switch SW 52 is simplified.

In the above description, the switch SW52 is provided between the data input terminal 81 and the voltage Vss in order to fix an input signal during the sustain period to the L level. However, it does not matter if the switch SW52 is provided between the data input terminal 81 and the power supply voltage Vdd and the input signal is fixed to the H level.

Third Embodiment

Next, a third embodiment of the present invention will be described.

Figure 7:
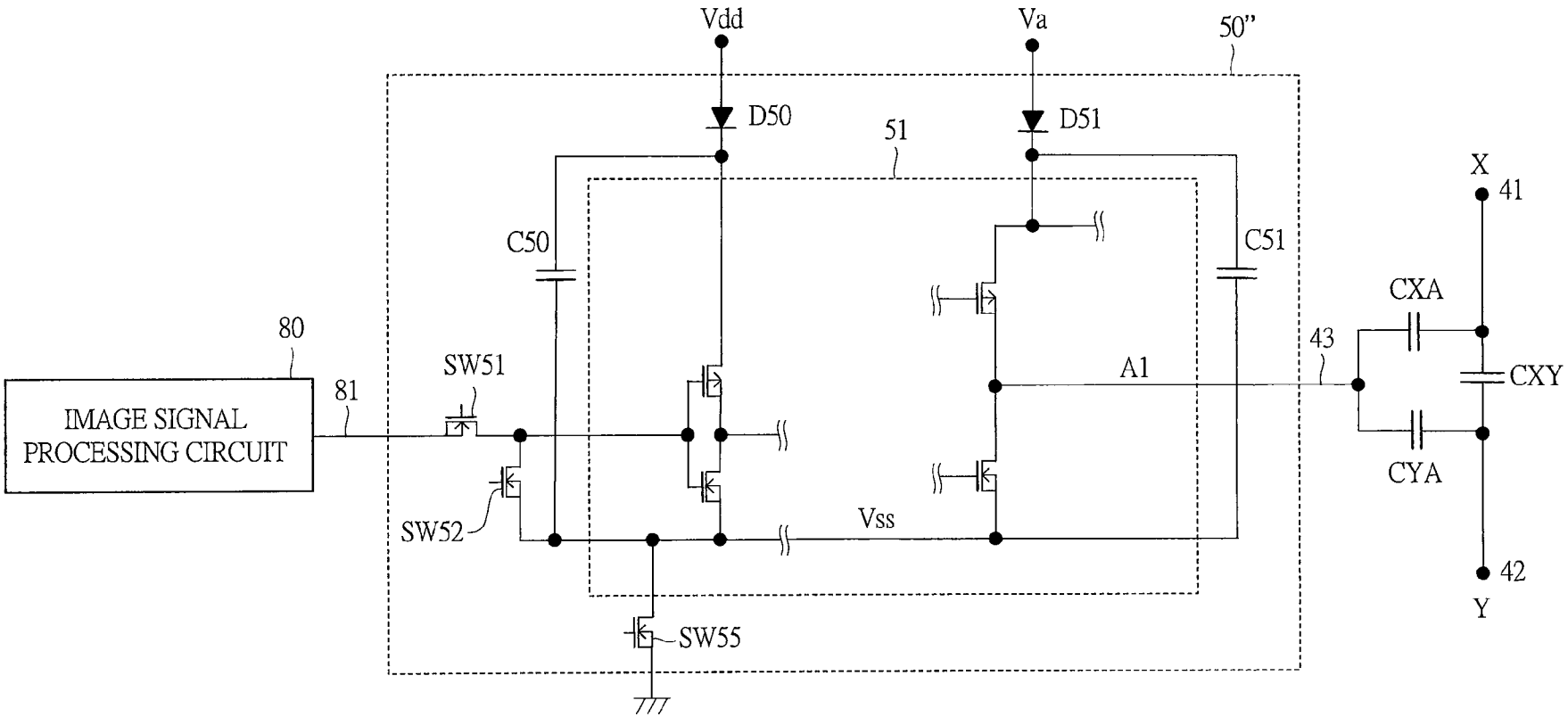
FIG. 7 is a circuit diagram showing an address drive circuit according to a third embodiment.

FIG. 7 is a circuit diagram showing an address drive circuit 50" according to the present embodiment.

In the first embodiment, it is necessary to block the power supply of the address drive circuit in order to keep the floating state of the address electrode 43 when the sustain drive voltage exceeds the address drive voltage. For its achievement, the switches SW53 and SW54 have been provided.

Also in the third embodiment, it is necessary to block the power supply of the address drive circuit in order to keep the floating state of the address electrode 43 when the sustain drive voltage exceeds the address drive voltage. In the third embodiment, diodes D50 and D51 are used instead of the power supply control switches SW53 and SW54.

More specifically, each switch in the first embodiment is merely required to block the power supply only when the address drive voltage exceeds the sustain drive voltage. Accordingly, it is possible to use the diodes instead of the MOS transistor switches like the present embodiment.

Note that it goes without saying that this method can be used in combination with the second embodiment without any problems.

Fourth Embodiment

Next, a fourth embodiment of the present invention will be described.

Figure 8:
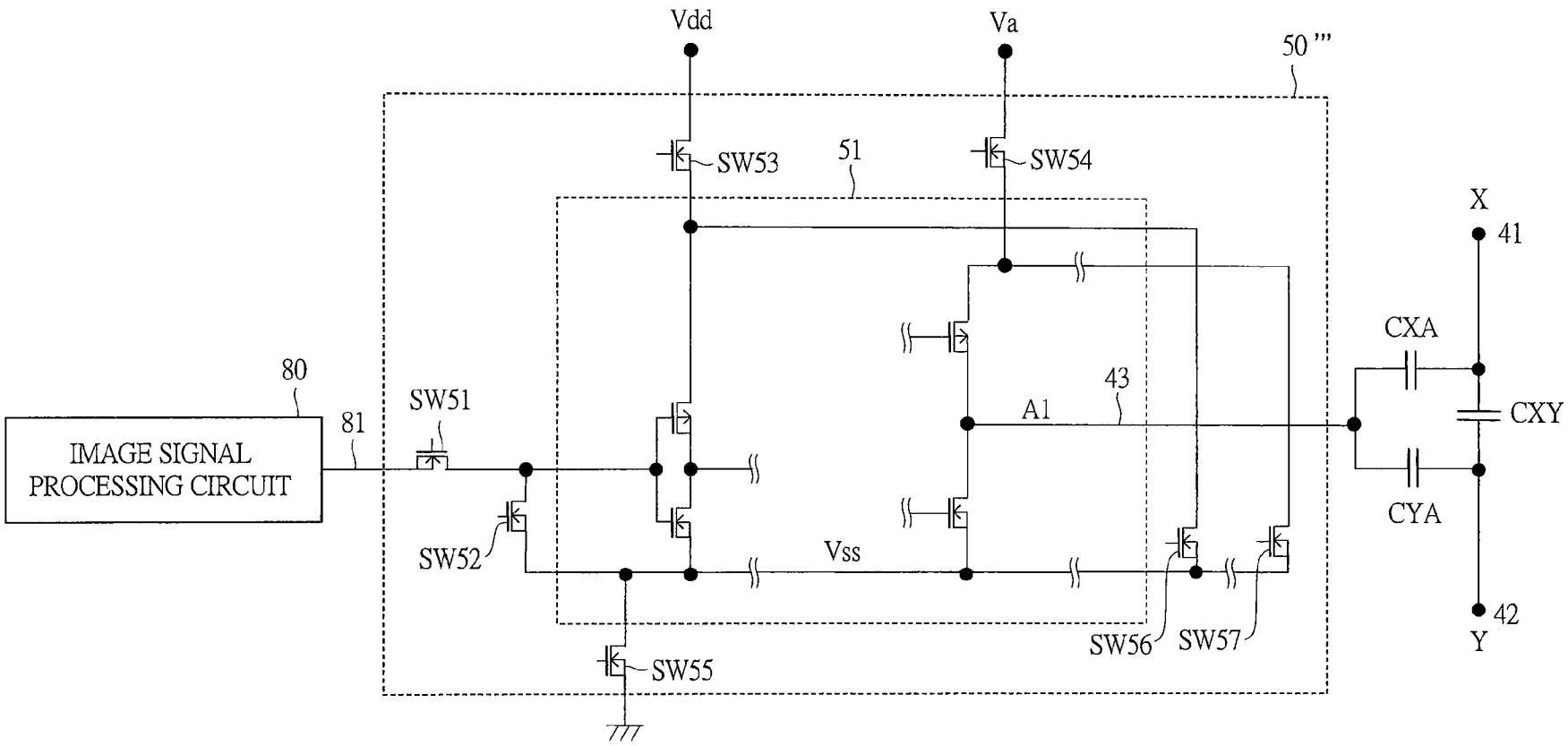
FIG. 8 is a circuit diagram showing an address drive circuit according to a fourth embodiment.

FIG. 8 is a circuit diagram showing an address drive circuit 50''' according to the present embodiment.

As described in the first embodiment, the high impedance in the address drive circuit during the sustain period can be realized by providing a plurality of switches in the address drive circuit 50.

However, the sustain voltages Vs1 and Vs2 are generally higher than the address voltage Va. Therefore, there is the possibility that a potential difference equal to or higher than the transiently-rated address voltage Va occurs in the address drive circuit 50 in the floating state and a circuit is damaged.

In the address drive circuit 50''' according to the fourth embodiment of the present invention, measures are taken for the possibility.

More specifically, by providing switches SW56 and SW57 by which the power supply voltage Vdd and the address voltage Va to the conventional address drive circuit 51 in the address drive circuit 50''' can be short-circuited to the voltage Vss, the occurrence of the potential difference in the address drive circuit 50''' is prevented.

Note that it goes without saying that this method can also be used in combination with the second embodiment without any problems.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be utilized in a power recovery circuit in a plasma display apparatus, but the use thereof is not necessarily limited thereto. By modifying control timings and others, the power recovery circuit according to the present invention can be applied to any high voltage system apparatus in which the power recovery is necessary.

What is claimed is:

1. An address drive circuit for driving address electrodes of a plasma display panel, comprising:

a plurality of output side switch elements which can switch and output an address voltage and a non-address voltage to an address electrode side;

an address voltage control switch provided on a power supply side of the plurality of output side switch elements;

a data input terminal to which a signal from an image signal processing circuit is input;

a power supply voltage control switch provided on a power supply side of the data input terminal;

an input signal switch for blocking an input signal, provided between the image signal processing circuit and the address drive circuit; and a grounding control switch which performs switching whether or not the non-address voltage is grounded, wherein the input signal switch, the address voltage control switch, the power supply voltage control switch, and the grounding control switch are turned OFF during a sustain period, and the address drive circuit is put in a floating state.

2. An address drive circuit for driving address electrodes of a plasma display panel, comprising:

a plurality of output side switch elements which can switch and output an address voltage and a non-address voltage to an address electrode side;

an address voltage control switch provided on a power supply side of the plurality of output side switch elements;

a data input terminal to which a signal from an image signal processing circuit is input;

a power supply voltage control switch provided on a power supply side of the data input terminal;

an input signal switch for blocking an input signal, provided between the image signal processing circuit and the address drive circuit;

a grounding control switch which performs switching whether or not the non-address voltage is grounded; and a logic input fixing switch which connects the non-address voltage and the data input terminal, wherein:

the input signal switch, the address voltage control switch, the power supply voltage control switch, and the grounding control switch are turned OFF during a sustain period, and the address drive circuit is put in a floating state, and the data input terminal of the address drive circuit is fixed by turning ON the logic input fixing switch.

3. The address drive circuit according to claim 2, wherein a MOS transistor or a diode is applied to the address voltage control switch.

4. The address drive circuit according to claim 3, wherein a MOS transistor or a diode is applied to the power supply voltage control switch.

5. A plasma display apparatus, comprising:

a plasma display panel;

sustain drive circuits each including a power recovery circuit provided on a scan electrode side and a sustain electrode side of the plasma display panel; and an address drive circuit which includes a plurality of output side switch elements which can switch and output an address voltage and a non-address voltage to an address electrode side and is provided with an address voltage control switch on a power supply side of the plurality of output side switch elements, the address drive circuit further including: a data input terminal to which a signal from an image signal processing circuit is input, and a power supply voltage control switch provided on a power supply side of the data input terminal;

an input signal switch for blocking an input signal, provided between the image signal processing circuit and the address drive circuit;

a grounding control switch which performs switching whether or not the non-address voltage is grounded; and a logic input fixing switch which connects the non-address voltage and the data input terminal, wherein the input signal switch, the address voltage control switch, the power supply voltage control switch, and the grounding control switch are turned OFF during a sustain period, and the address drive circuit is put in a floating state, and the data input terminal of the address drive circuit is fixed by turning ON the logic input fixing switch.

* * * * *